United States Patent [19]

Hasegawa et al.

[11] 4,042,468

[45] Aug. 16, 1977

[54] PROCESS FOR ELECTROLYTICALLY COLORING ALUMINUM AND ALUMINUM ALLOYS

[75] Inventors: Mutsuo Hasegawa, Uozu; Kazuo Aikawa; Shinji Hayashi, both of Toyama, all of Japan

[73] Assignee: Yoshida Kogyo Kabushiki Kaisha, Tokyo, Japan

[21] Appl. No.: 663,561

[22] Filed: Mar. 3, 1976

[30] Foreign Application Priority Data

Mar. 6, 1975 Japan ..... 50-26519

[51] Int. Cl.[2] ..... C25D 11/22

[52] U.S. Cl. ..... 204/42; 204/35 N

[58] Field of Search ..... 204/35 N, 58, 56 R, 204/42; 427/419

[56] References Cited

U.S. PATENT DOCUMENTS

| | | | |
|---|---|---|---|
| 3,878,056 | 4/1975 | Yanagida et al. | 204/35 N |
| 3,962,049 | 6/1976 | Ueki | 204/35 N |

*Primary Examiner*—G. L. Kaplan

*Attorney, Agent, or Firm*—Hill, Gross, Simpson, Van Santen, Steadman, Chiara & Simpson

[57] ABSTRACT

Aluminum or aluminum alloy is first anodized to form an oxide film thereon. Before being colored electrolytically in an electrolytic solution, the anodized basis metal is made anodic in this solution, and direct current is passed therethrough. The basis metal is then electrolyzed in the same solution by use of alternating current for actual coloring operation. The electrolytic solution in use contains at least two metallic salts, together with or without a strongly reducing compound.

6 Claims, No Drawings

PROCESS FOR ELECTROLYTICALLY COLORING ALUMINUM AND ALUMINUM ALLOYS

BACKGROUND OF THE INVENTION

1. Field of the Invention

This invention relates to a process for electrolytically coloring aluminum or any of its various alloys.

2. Prior Art

For electrolytic coloring of aluminum or aluminum alloy, there has been proposed and used a process wherein the basis metal is first anodized to form an oxide film thereon and then, with the pores in this oxide film unsealed, electrolyzed in an electrolytic solution containing a metallic salt such as a nickel salt by use of alternating or direct current. The basis metal is colored by electrodeposition of the metal or metal oxide in the pores of the oxide film thereon. This process has gained widespread acceptance in the industry partly because of the high weather resistance of the colored coatings produced.

The colored coating produced by such a prior art process, however, is generally poor in uniformity, so that particularly in the case of an irregularly shaped workpiece, its protuberant and recessed portions tend to be tinted in noticeably different shades. Another disadvantage is that a further decrease in the uniformity of coloring takes place if the basis metal is allowed to stand too long after the anodic treatment or if the basis metal is rinsed too long, particularly in liquid having a low pH value, after the anodic treatment.

SUMMARY OF THE INVENTION

It is therefore an object of this invention to provide an improved process for electrolytically coloring aluminum or aluminum alloy, in such a manner that the basis metal can be colored uniformly regardless of its shape.

Another object of the invention is to provide a process of the character described such that colored coatings formed on the basis metal have excellent weather resistance and other properties. Briefly, according to the process of this invention, aluminum of aluminum alloy is first anodized to form an oxide film thereon, and the oxide film thus formed is rinsed. With the pores in this oxide film unsealed, the anodized basis metal together with a counter electrode is immersed in an electrolytic solution, and before being colored electrolytically therein, substantially direct current is passed through the solution with the anodized basis metal made anodic therein. Thereafter the basis metal is electrolyzed in the same solution by use of alternating current for actual coloring operation.

The term "substantially direct current" as used herein and in the appended claims is understood to include not only direct current in the strict sense of the term but also other essentially identical currents such as, for example, those produced by fullwave rectification of single-phase alternating current or by rectification of three-phase alternating current.

The invention is based upon the discovery that the electrolytic pretreatment of the anodized basis metal with substantially direct current results in remarkable improvement in uniformity with which the basis metal is colored by the subsequent electrolysis in the same electrolytic solution with the use of alternating current. Such improved uniformity of coloring is substantially unimpaired no matter how long the basis metal is rinsed after the anodic treatment. The electrolytic solution for use in the process of this invention contains at least two metallic salts and, if desired, a strong reducing compound.

The above and other objects, features and advantages of this invention will become more apparent and understandable from the following detailed description, Examples, and claims.

DETAILED DESCRIPTION OF THE INVENTION

Aluminum and aluminum alloys to be colored by the process of this invention comprise pure aluminum and the alloys of pure aluminum and one or more of such elements as silicon, magnesium, copper, nickel, zinc, chromium, lead, bismuth, iron, titanium, and manganese.

For anodizing aluminum or any of such aluminum alloys, the basis metal may first be degreased, rinsed and otherwise suitably pretreated in the conventional manner. The pretreated basis metal is then made anodic in the usual acid electrolytic solution containing sulfuric acid, oxalic acid, sulfamic acid or the like, and electric current is passed through the solution between the anodic basis metal and a cathode also immersed therein as the counter electrode.

According to the process of this invention, the anodized basis metal is then subjected to two successive steps of electrolysis in one and the same electrolytic solution which contains at least two metallic salts and, if desired, a strongly reducing compound. The first step of electrolysis is effected by passing substantially direct current through the electrolytic solution, with the anodized basis metal made anodic therein. The voltage used in this first step of electrolysis should be from about 10 to 50 volts and, for the best results, from about 15 to 30 volts. The voltage is applied for not more than about 5 minutes and, for the best results, for about 5 to 60 seconds. As the second step of electrolysis, alternating current is passed through the same solution, at a voltage ranging from about 5 to 50 volts and, for the best results, from about 10 to 30 volts.

By the foregoing two steps of electrolysis, the basis metal can be colored with an extremely high degree of uniformity, no matter how long it has been rinsed after the anodic treatment. It has also been confirmed by experiment that if the anodized basis metal is subjected to the first step of electrolysis at a voltage considerably higher than that of the second step, and for a relatively long period of time, then the coloring of the basis metal in the second step of electrolysis proceeds very slowly.

It has been well known that in electrolytic coloring of workpieces by use of alternating current, a darker shade is usually produced on those portions of the workpieces which permit easier flow of current therethrough, than on other portions where current is less easy to flow. In practice, therefore, the end portions of the workpieces tend to be tinted darker than the othe portions, and if the workpieces are shaped irregularly, their protuberant portions tend to be tinted darker than the recessed portions. In order to overcome such irregularities of coloring, masking has heretofore been applied to the counter electrodes, but the masking adjustment is very troublesome.

According to the process of this invention, however, the anodized basis metal is first electrolyzed by use of substantially direct current, with the result that in the subsequent step of electrolysis with alternating current, those portions of the basis metal which permit easier current flow therethrough become relatively difficult to be colored, whereas the other portions where current is less easy to flow do not become so difficult to be colored as the first mentioned portions. Herein lies the basis on which this invention is founded. As will be understood, the first step of electrolysis with substantially direct current serves the purposes of conventional masking, so that by the second step of electrolysis with alternating current, a desired color can be produced in unvarying shade both on the end or protuberant portions of the basis metal which permit easier current flow therethrough and on its central or recessed portions where current is less easy to flow.

The aforementioned metallic salts for use in the electrolytic solution according to the invention can be selected, for example, from such inorganic acid salts as sulfates, phosphates, hydrochlorides, chromates and nitrates of various metals typically comprising nickel, cobalt, chromium, copper, magnesium, iron, cadmium, titanium, manganese, molybdenum, calcium, vanadium, tin, lead, and zinc; and such organic salts as oxalates, acetates and tartrates. For a higher speed of coloring, the electrolytic solution should contain at least three of such metallic salts, or at least two of such metallic salts and a strongly reducing compound. The concentration of the total amount of any two or more selected metallic salts in the electrolytic solution should be in the range of from about five to 500 grams per liter and, for the best results, from about 10 to 250 grams per liter.

A strongly reducing compound to be added as required to the electrolytic solution according to the invention can be selected, for example, from such dithionites (hydrosulfites) as sodium dithionite and zinc dithionite; such thiosulfates as ammonium thiosulfate, sodium thiosulfate, potassium thiosulfate and iron thiosulfate; such bisulfites as sodium hydrogen sulfite and potassium hydrogen sulfite; sulfurous acid; such sulfites as ammonium sulfite, sodium sulfite and potassium sulfite; thioglycolic acid; and such thioglycolates as ammonium thioglycolate, sodium thioglycolate, potassium thioglycolate and lithium thioglycolate. The concentration of any selected strong reducing compound in the electrolytic solution should be in the range of from about 0.05 to 10 grams per liter and, for the best results, from about 0.5 to 3 grams per liter.

Usually, there is further added to the electrolytic solution for use in the process of this invention at least one of such inorganic acids as sulfuric acid, nitric acid, hydrochloric acid, phosphoric acid, boric acid, thiocyanic acid and chormic acid; such organic acids as oxalic acid, acetic acid, propionic acid, formic acid, tartaric acid and malic acid; an their ammonium salts, amino salts and imino salts. The concentration of any selected one of these substances in the electrolytic solution should be in the range of from about 5 to 250 grams per liter.

For further improvement in the uniformity of coloring, the alternating current voltage at which the second step of electrolysis is effected may be lowered at least once during its progress. The difference between the starting and the subsequently lowered voltages should be from about 1 to 10 volts. The voltage should be lowered within about two minutes, preferably in about 5 to 60 seconds, following the start of the second step of electrolysis.

The pores in the oxide film on the basis metal which has been colored by the process of this invention as hereinabove described may be sealed by boiling water, by chemicals, or by live steam, as has been known heretofore. After, or without, the sealing treatment, the colored surfaces may be coated with a suitable resin paint as by the dipping or electrodeposition method provide protection.

The inventive process is hereinafter described more specifically in terms of several Inventive Examples, which, however, are meant purely to illustrate or explain and not to impose limitations upon the invention. Also given hereinbelow are some Comparative Examples which are intended to make clear the advantages of the inventive process.

INVENTIVE EXAMPLE I

Prior to anodic treatment, a specimen consisting of an aluminum extrusion sized 150 millimeters by 70 by 1.3 was degreased, etched and desmutted in the usual manner. The thus pretreated specimen was made anodic in an aqueous solution of 17.5 W/V % sulfuric acid, and a direct current voltage of 15 volts was impressed for 35 minutes across the anodic specimen and an aluminum cathode connected as the counter electrode in the bath. The current density was 1.2 amperes per square decimeter. An oxide film with a thickness of about 12 microns was thus formed on the specimen, which was then rinsed for 12 hours in flowing water.

For electrolytically coloring the above anodized specimen, there was used a vessel with a length of 300 millimeters, a width of 100 millimeters and a height of 150 millimeters. This vessel was filled with an electrolytic solution of the following composition:

| | |
|---|---|
| Nickel sulfate (hexahydrate) | 30 g/l |
| Magnesium sulfate (heptahydrate) | 10 g/l |
| Ammonium sulfate | 35 g/l |
| Ammonium thiosulfate | 1 g/l |
| Boric acid | 10 g/l |
| DL-malic acid | 1 g/l |

The pH of the above electrolytic solution was 5.6, and its temperature was 20° C.

The anodized specimen which had been prepared as described above was immersed in this solution, and a carbon electrode was also immersed therein at a distance of 250 millimeters from the specimen. As the first step of electrolysis, a direct current voltage of 18.5 volts was impressed for 20 seconds across the specimen, which was made anodic, and the carbon cathode. The specimen was then subjected to the second step of electrolysis for 6 minutes by use of alternating current at 12.5 volts. The specimen was uniformly colored bronze on both of its surface which had been facing the counter electrode and its outer surface which had been directed away from the counter electrode.

The above produced colored film on the specimen was then subjected to sealing treatment for 30 minutes by means of live steam, under pressure of 5 kilograms per square centimeter. A 3000-hour accelerated weathering test of the finished specimen by means of a weatherometer developed no change in its colored film. Also, no change in color took place when the specimen was heated to a temperature of 200° C for 2 hours, and the specimen remained intact when subjected to a 16-hour CASS (copper-accelerated acetic acid salt spray) test. It has thus been confirmed that aluminum or aluminum alloy colored by the process of this invention will sufficiently withstand outdoor use as structural members.

INVENTIVE EXAMPLE II

An aluminum extrusion sized 150 millimeters by 70 by 1.3 was anodized by use of the procedure described in Inventive Example I to form thereon an oxide film with a thickness of about 12 microns. The anodized specimen was rinsed for 6 hours in flowing water and was then subjected to two consecutive steps of electrolysis in an electrolytic solution of the following composition, which was filled in the same vessel as in Inventive Example I:

| | |
|---|---|
| Nickel sulfate (hexahydrate) | 30 g/l |
| Magnesium sulfate (heptahydrate) | 10 g/l |
| Ammonium sulfate | 35 g/l |
| Boric acid | 10 g/l |

The pH of this electrolytic solution was 5.6, and its temperature was 30° C.

The anodized specimen was immersed in the above solution together with a carbon electrode. As the first step of electrolysis, substantially direct current produced by full-wave rectification of single-phase alternating current was passed through the solution for 10 minutes at a voltage of 26 volts, with the anodized specimen made anodic and the carbon electrode made cathodic. The specimen was then subjected to the second step of electrolysis for 5 minutes by use of alternative current at 16 volts. The specimen was uniformly colored slightly reddish gray on both of its surfaces.

The pores in the thus produced colored film on the specimen were sealed in the same manner as in Inventive Example I. The finished specimen exhibited the same favorable results as that of the preceding Example when subjected to a 3000-hour accelerated weathering test by means of a weatherometer, a 2-hour heating test at a temperature of 200° C, and a CASS test.

INVENTIVE EXAMPLE III

By use of procedure of Inventive Example I, an aluminum extrusion sized 150 millimeters by 70 by 1.3 was anodized to form thereon an oxide film with a thickness of about 12 microns. The anodized specimen was rinsed for 12 hours in flowing water and was then subjected to two successive steps of electrolysis in an electrolytic solution of the following composition, which was filled in the same vessel as in Inventive Example I:

| | |
|---|---|
| Nickel sulfate (hexahydrate) | 30 g/l |
| Magnesium sulfate (heptahydrate) | 10 g/l |
| Ammonium sulfate | 35 g/l |
| Ammonium thiosulfate | 1 g/l |
| Boric acid | 10 g/l |
| Maleic acid | 0.5 g/l |

The pH of this electrolytic solution was 5.6, and its temperature was 20° C.

The anodized specimen was immersed in the above solution together with a sheet of stainless steel as the counter electrode. As the first step of electrolysis, a direct current voltage of 25 volts was impressed for 20 seconds across the specimen, which was made anodic, and the stainless steel cathode. The second step of electrolysis was effected for 5 minutes by use of alternating current at 18 volts. The specimen was uniformly colored deep bronze on both of its surfaces.

The pores in the thus produced colored film on the specimen were sealed in the same manner as in Inventive Example I. The finished specimen exhibited the same favorable results as that of Inventive Example I when subjected to a 3000-hour accelerated weathering test by means of a weatherometer, a 2-hour heating test at a temperature of 200° C, and a CASS test.

INVENTIVE EXAMPLES IV - VII

The strongly reducing compounds listed in the following table were used in lieu of ammonium thiosulfate in the electrolytic solution of Inventive Example III, to prepare four different electrolytic solutions:

| Example | Strongly Reducing Compound | Concentration (g/l) | pH |
|---|---|---|---|
| IV | Thioglycolic acid | 1.5 | 4.5 |
| V | Ammonium thioglycolate | 1.5 | 5.6 |
| VI | Ammonium sulfite | 2.0 | 5.6 |
| VII | Ammonium hydrogen sulfite | 1.0 | 5.6 |

An aluminum extrusion of the size described above was anodized, rinsed, and electrolyzed in two successive steps in each of the above four electrolytic solutions, by use of the procedure described in Inventive Example III. The results in each case were as favorable as those set forth in Inventive Example III.

INVENTIVE EXAMPLE VIII

Two specimens each consisting of an aluminum extrusion sized 150 millimeters by 70 by 1.3 were anodized by use of the procedure described in Inventive Example I to form thereon oxide films with a thickness of about 12 microns. The anodized specimens were rinsed for 12 hours in flowing water and were then subjected to two successive steps of electrolysis in an electrolytic solution of the following composition, which was filled in the same vessel as in Inventive Example I:

| | |
|---|---|
| Nickel sulfate (hexahydrate) | 25 g/l |
| Magnesium sulfate (heptahydrate) | 15 g/l |
| Ammonium sulfate | 35 g/l |
| Ammonium thiosulfate | 1 g/l |
| Boric acid | 20 g/l |

The pH of this electrolytic solution was 5.6, and its temperature was 20° C.

The two anodized specimens which had been prepared as above were immersed in the above solution with a spacing of 10 millimeters therebetween, and a carbon electrode was positioned at a distance of 250 millimeters from the specimens. As the first step of electrolysis, a direct current voltage of 24 volts was impressed for 15 seconds across the specimens, which were made anodic, and the carbon cathode. The second step of electrolysis was effected for 20 seconds by use of alternating current at a starting voltage of 24 volts, and then, by lowering the alternating current voltage to 16 volts, the second step of electrolysis was continued another 5 minutes. All the four surfaces of the two specimens were uniformly colored bronze.

The above obtained colored films on the specimens were then subjected to sealing treatment by the same method as in Inventive Example I. The finished specimens exhibited the same favorable results as that of Inventive Example I when subjected to a 3000-hour accelerated weathering test by means of a weatherometer, a 2-hour heating test at a temperature of 200° C, and a CASS test.

COMPARATIVE EXAMPLE I

By use of the procedure of Inventive Example I, an aluminum extrusion of the size described above as anodized to form thereon an oxide film with a thickness of about 12 microns. The anodized specimen was rinsed for 12 hours in flowing water. For electrolysis, there were used the same vessel, and the electrolytic solution of the same composition, as in Inventive Example I. The anodized specimen was electrolyzed for 6 minutes by use of alternating current at 12.5 volts in the electrolytic solution having a temperature of 20° C. The specimen was colored in bronze, but one of its surfaces which had been facing the counter electrode had an appreciably darker shade than the opposite surface, in striking contrast to the specimen of Inventive Example I which was colored uniformly on both of its surfaces.

COMPARATIVE EXAMPLE II

By use of the procedure of Inventive Example I, an aluminum extrusion of the size described above was anodized to form thereon an oxide film with a thickness of about 12 microns. The anodized specimen was rinsed for 12 hours in flowing water. For electrolysis, there was used the same vessel as in Inventive Example I, in which was filled the electrolytic solution of the same composition as in Inventive Example III. The anodized specimen was electrolyzed for 5 minutes by use of alternating current at 18 volts in the electrolytic solution having a temperature of 20° C. The specimen was colored bronze, but one of its surfaces which had been directed away from the counter electrode had a remarkably lighter shade than the opposite surface, and the color of the first mentioned surface became still lighter toward its center. These results are in striking contrast to those of Inventive Example III, in which the specimen was colored uniformly deep bronze on both of its surfaces.

What is claimed is:

1. A process for electrolytically coloring aluminum or aluminum alloy which comprises anodizing a desired basis metal, electrolyzing the anodized basis metal by use of substantially direct current with the basis metal made anodic in an acidic aqueous electrolyte containing at least two coloring metallic salts in an amount of about 5 to 500 grams per liter, and further electrolyzing the basis metal in the same electrolyte by use of alternating current.

2. The process as recited in claim 1, wherein the basis metal is electrolyzed by use of the substantially direct current at a voltage in the range of from about 10 to 50 volts.

3. The process as recited in claim 1, wherein the basis metal is electrolyzed by use of the substantially direct current for not more than about 5 minutes.

4. The process as recited in claim 1, wherein the basis metal is electrolyzed by use of the alternating current at a voltage in the range of from about 5 to 50 volts.

5. The process as recited in claim 1, wherein the metallic salts are selected from the group consisting of the inorganic acid salts sulfates, phosphates, hydrochlorides, chromates, and nitrates of the metals nickel, cobalt, chromium, copper, magnesium, iron, cadmium, titanium, manganese, molybdenum, calcium, vanadium, tin, lead, and zinc; and the organic acid salt oxalates, acetates and tartrates.

6. The process as recited in claim 1, wherein the electrolyte further contains a strong reducing compound selected from the group consisting of dithionites, thiosulfates, bisulfites, sulfurous acid, sulfites, thioglycolic acid and thioglycolates in the amount of from about 0.05 to 10 grams per liter.

* * * * *